United States Patent [19]

Sinclair et al.

[11] 4,186,230

[45] Jan. 29, 1980

[54] THERMOPLASTIC MOLDABLE LATEX FOAM MAT

[75] Inventors: Edward A. Sinclair, Kent; John M. Kalbfleisch, Cuyahoga Falls, both of Ohio

[73] Assignee: The Goodyear Tire & Rubber Company, Akron, Ohio

[21] Appl. No.: 947,918

[22] Filed: Oct. 2, 1978

[51] Int. Cl.[2] ..... D03D 27/00; D04H 11/00

[52] U.S. Cl. ..... 428/95; 428/96; 428/97; 428/174; 428/175

[58] Field of Search ..... 428/95, 96, 97, 174, 428/175

[56] References Cited

U.S. PATENT DOCUMENTS

| | | | |
|---|---|---|---|
| 3,953,632 | 4/1976 | Robinson | 428/95 |
| 4,016,318 | 4/1977 | DiGioia | 428/95 |
| 4,078,100 | 3/1978 | Doerfling | 428/95 |

*Primary Examiner*—Marion E. McCamish
*Attorney, Agent, or Firm*—J. D. Wolfe

[57] ABSTRACT

A moldable tufted carpet automobile mat, the molded mat and the process of preparing the mat, the moldable automobile mat comprising in combination: a nonwoven fabric or a tufted carpet having a tufted face surface and a back surface; a latex precoat; a thin layer of a stiff, heat-moldable thermoplastic foam of a blend of an elastomer and a resin having a thickness of up to about one-eighth to about three-eighths of an inch.

1 Claim, No Drawings

THERMOPLASTIC MOLDABLE LATEX FOAM MAT

TECHNICAL FIELD

This invention relates to a method of making shaped mats having a moldable foam back and to said mats.

BACKGROUND ART

Automobile mats used for covering the flooring of an automobile are typically molded laminated products, and often are composed of a tufted carpet which has a felt or heavy jute padding laminated to the back surface thereof by the use of a hot-melt thermoplastic adhesive. Automobile mats so prepared are heated and molded prior to use to form a molded automobile mat of a molded stiff form, for example, wherein the mat will fit over the transmission hump on the floor of the automobile, and which mat has open areas cut for the accelerator and brake pedals, so that the molded laminated automobile mat may be easily inserted onto the floor of an automobile.

Automobile mats prepared with the use of felt and heavy jute padding as a backing are not wholly satisfactory since both felt and jute are often imported, and the deliveries and qualities of these materials suffer wide variations. In addition, felt and jute tend to absorb water, and further, felt paddings are difficult to be molded, so that they often must be precut prior to the laminating step.

A typical process for the preparation of a tufted carpet automobile carpet mat would comprise the sprinkling of a relatively uniform coating of a hot-melt adhesive material, such as polyethylene or a modified polyethylene material in flake or pellet form, onto the back surface of a roll of tufted carpet. The coated carpet is then introduced into and sent through an oven or under infrared heaters and the hot-melt material melted for a time to coat the back surface of the carpet. The carpet and hot-melt adhesive are then cooled, cut to size and stacked. The hot-melt adhesive serves as a means to anchlor the tufts of the carpet where the face surface of the automobile mat has a tufted carpet, and in addition serves later to laminate a precut felt pad to the back surface of the carpet. At room temperature of 60° to 80° F. or slightly above, e.g., up to about 100° F., the hot-melt adhesive imparts a stiff form to the automobile mat. When an automobile mat is to be prepared, precut felt padding material is placed into a mold, the hot-melt surface on the coated carpet is then heated up to soften the surface, such as by the use of a hot-air oven or by radiant infrared heaters, and then placed into the mold. The mold, while the hot-melt adhesive is temperature-moldable, forms the carpet and padding to the desired shape. Where the carpet is sufficiently pliable by preheating, the carpet may be cold-molded and then the molded automobile mat removed and stored, nested together ready for shipment or use.

It is desirable to prepare automobile mats without the use of felt or jute padding, and without the use of precutting of such padding, and to prepare such mats on a production basis. In addition, it would be most advantageous to prepare an automobile mat with better cushioning and sound-deadening and bulk and mobility characteristics than the prior-art automobile mats.

U.S. Pat. No. 4,016,318 describes use of polyurethane for making these mats and furnishes a drawing of typical coating, slitting, heating and cold molding the mat.

DISCLOSURE OF INVENTION

The invention relates to an improved laminate product, such as a moldable automobile mat having a flexible elastomeric resin foam backing layer, to the method of preparing such an improved automobile mat and to the molded automobile mat produced thereby. In particular the invention relates to an improved tufted carpet or nonwoven fabric, moldable automobile mat having a thin, stiff, thermoplastic, elastomeric foam, flexible, backing layer, to the method of preparing such mat and to the molded mat prepared thereby.

The laminate material comprises a sheet material, such as a tufted or nonwoven carpet, wherein a fibrous material is tufted or otherwise inserted into or secured to a sheet scrim material to form a fibrous face surface material and a back surface with a layer of a thermoplastic, elastomer resin foam bonded to the back surface of the sheet. When using tufted carpet it is preferred that the carpet has a latex pre-coat prior to application of foam.

In one embodiment the laminate produced employs a tufted carpet layer wherein natural or synthetic or a combination of fibers are tufted into a sheet scrim material to present a tufted fibrous face surface, with the laminate product with such face surface designed, for example, to be used as a molded automobile floor covering or other molded covering surface. Typically the face surface is molded or otherwise contoured and cut in size to fit into the designated space and floor contour arrangement of the particular automobile in which the carpet is to be used.

In another embodiment a nonwoven mat of polyester or polyamide filaments is coated with a blend of a thermoplastic, elastomeric resin foam and is molded to give a relatively stiff, yet flexible, mat suitable for use as an automobile mat. By relatively stiff is meant the mat will retain its shape in an unsupported position for at least several minutes.

The foam for use in coating the carpet or mats is made from a blend of 15 to 50, and preferably 20 to 40, parts of a resinous latex such as polystyrene or high styrene/butadiene latex (15 to 100 mol percent styrene) with 85 to 50, and preferably 80 to 60, parts of an elastomeric latex such as the elastomeric butadiene/styrene latices or natural rubber latex. Then this blend of resinous and elastomeric latices are compounded with curatives and pigments well known in the art and foamed in customary manner by whipping in air either with or without a gellant, depending on whether the compounds are of the well known gel or non-gel types. The carpet or mat may be pre-coated with a latex compound prior to application of latex foam, which is subsequently passed beneath a doctor knife or roll to coat the sheet with the foam to the desired thickness, usually from $\frac{1}{8}$ to about $\frac{1}{2}$ inch, then passed through a heating station to dry and cure the foam and then to a cutting station to cut the mat from the sheet. The cut mat containing a foamed backing preferably is heated and then molded into the shape of the automobile cavity. The shaped mat is relatively shape maintaining during storage and installation to facilitate the mat's installation, b t flexible enough with time to assume a more exact contour of the automobile cavity. Also, the thermoplastic resinous elastomeric foam coating gives a soft feel and some sound deadening.

BEST MODE FOR CARRYING OUT THE INVENTION

The nature of this invention and its advantages can be more readily appreciated by reference to the following examples where all parts are by dry weight.

EXAMPLE 1

| | phr (Dry) |
|---|---|
| Pliolite 5356K[1] | 70 |
| Pliolite 151[2] | 30 |
| Disodium octadecyl sulfosuccinamate | 4.5 |
| KOH | 0.3 |
| Tetrapotassium pyrophosphate | 0.5 |
| Zinc oxide | 1.5 |
| Ethyl zimate (zinc diethyl dithiocarbamate) | 0.5 |
| Zinc captax | 1.5 |
| Phenolic antioxidant | 0.75 |
| Sulfur | 2.0 |
| Calcium carbonate | 100.0 |
| Alumina trihydrate | 50.0 |
| Total | 261.55 |

[1]Pliolite 5356K is a trademark of The Goodyear Tire & Rubber Company and is an elastomeric copolymer of 75 percent butadiene and 25 percent styrene.
[2]Pliolite 151 is a trademark of The Goodyear Tire & Rubber Company and is a latex of a resinous copolymer of 15 percent butadiene and 85 percent styrene.

The above ingredients were mixed in the order shown. The resultant compound was frothed in a Hobart mixer to the desired density, preferably 15 to 40 pounds per cubic foot (0.24 to 0.64 grams per cubic centimeters). The froth was then spread at the requisite thickness on the back of the substrate. The composite was treated 10 seconds in an infrared heater and then cured at 280° F. for 40 minutes. Upon being removed from the oven the hot composites were formed into various shapes which they retained upon cooling. After cooling the composite can be reheated and molded to the desired shape.

EXAMPLE 2

The procedure of Example 1 was used except for the substitution of polystyrene for the 85/15 styrene/-butadiene copolymer and 100 parts of barium sulfate for the calcium carbonate, and the alumina trihydrate was increased to 100 parts. These changes increased the sag point from about 55° C. to about 85° C. The sag point was determined on 1"×8" (2.54×20.32 centimeters) samples of the foam on nonwoven trunkliner fabric molded into a U shape. These samples were placed upright in an oven and the temperature increased in five-degree intervals and held at each interval for at least ½ hour. The approximate temperature at which the U shape began to relax was taken as the sag point.

While certain representative embodiments and details have been shown for the purpose of illustrating the invention it will be apparent to those skilled in this art that various changes and modifications may be made therein without departing from the spirit or scope of the invention.

We claim:

1. A molded mat which comprises a nonwoven fabric sheet or a tufted carpet having a tufted face surface and a back surface, at least one of said surfaces containing a coating of a foam, said foam being composed of a blend of 15 to 50 parts of a resin and 85 to 50 parts of an elastomer, said mat containing the foam coating being molded to give the mat a shaped contour, said resin being a polystyrene or copolymer of about 15 percent butadiene and about 85 percent styrene and said elastomer being a copolymer of about 75 percent butadiene and about 25 percent styrene or natural rubber.

* * * * *